United States Patent [19]

Mundus et al.

[11] Patent Number: 4,790,491

[45] Date of Patent: Dec. 13, 1988

[54] APPARATUS FOR WINDING UP A WEB SECTION WITHOUT USING A CORE

[75] Inventors: Friedhelm Mundus, Lengerich; Hans-Ludwig Voss, Tecklenburg, both of Fed. Rep. of Germany

[73] Assignee: Windmöller & Hölscer, Lengerich, Fed. Rep. of Germany

[21] Appl. No.: 908,776

[22] Filed: Sep. 18, 1986

[30] Foreign Application Priority Data

Sep. 18, 1985 [DE] Fed. Rep. of Germany ..... 3533321

[51] Int. Cl.[4] ..... B65H 19/20

[52] U.S. Cl. ..... 242/68.4; 242/56 A

[58] Field of Search ..... 242/56 A, 64, 68.4

[56] References Cited

U.S. PATENT DOCUMENTS

| | | | |
|---|---|---|---|
| 1,282,294 | 10/1918 | Ross | 242/64 |
| 1,537,458 | 5/1925 | Bull | 242/68.4 |
| 2,703,209 | 3/1955 | Crutcher | 242/64 |
| 3,345,009 | 10/1967 | Rockstrom | 242/56 A |
| 4,045,038 | 8/1977 | Abenshain | 242/68.4 X |

FOREIGN PATENT DOCUMENTS 2400016 5/1981 Fed. Rep. of Germany .

*Primary Examiner*—Stuart S. Levy
*Assistant Examiner*—Katherine Matecki
*Attorney, Agent, or Firm*—Fleit, Jacobson, Cohn & Price

[57] ABSTRACT

Apparatus for winding a web section without using a core, the web section including a plurality of transversely extending perforation lines and wherein a torn web section is removed from a continuously supplied web. The apparatus includes two winding stations that are diametrically opposed on opposite sides of rotatable, circular carrying discs. Each of the winding stations includes a pair of opposed winding heads, and the winding heads each includes a pair of winding pins that extend in the direction of the winding aixs. The pins are rotatably mounted for rotation as a pair about the winding axis and are connected to a rotary drive. The winding pins are also extendable to a winding position and are retractable to a non-winding position. When in the winding position the pins extend outwardly from the winding head and are spaced from each other a distance sufficient to receive a web therebetween, and upon rotation of the winding heads the web is wound into a roll without the need for a core.

11 Claims, 4 Drawing Sheets

APPARATUS FOR WINDING UP A WEB SECTION WITHOUT USING A CORE

BACKGROUND OF THE INVENTION

1. Field of the Invention

This invention relates to apparatus for winding up a web section without using a core, and in which the web section has been torn along a transverse perforation line from a web which is continuously supplied and provided with spaced transverse perforation lines.

2. Description of the Prior Art

In winding apparatus of the type disclosed in West German Patent Publication No. 21 27 128, winding pins, which in the winding position protrude freely over the width of the web, are secured to the free ends of levers, which are pivoted in a winding head and are held, e.g., by springs, in their inner, retracted position. The winding pins can be pivotally moved to their spread position by an axially displaceable mandrel, which has a conical end portion that engages corresponding cam faces of the level. That apparatus has a relatively expensive structure because the protruding winding pins must be extended and retracted substantially throughout the width of the web which is to be wound up, and as they are extended the pins must be be spread relative to each other to such an extent that the web can move freely between the winding pins to the other winding station.

West German Utility Model Specification No. 77 12 942 discloses winding heads which are provided with winding pins, which in their non-spread position are sufficiently spaced apart to permit the web to move between the winding pins. but the winding pins must protrude freely over a large length beyond the web to be wound so that they can be bent outwardly to their spread position by a spreading cone.

Swiss Patent Specification 487,791 discloses a winding apparatus having a winding station which is fixed to the frame and includes two mutually opposite pairs of winding pins, which are connected to rotary drive means and are adapted to be advanced toward a web that is to be divided into sections that are to be wound up without using a core. The two winding pins hold the web therebetween and are retractable from the side edges of the web when a roll is to be released. That apparatus serves for intermittent winding of web sections which have been severed from a continuous web. The winding pins are displaceable in a common plane toward and away from each other, and as they are advanced they move like tongs to grip the web. As they are retracted they perform a corresponding closing movement to reduce the frictional coupling between the winding pins and the roll, which can then easily be stripped from the winding pins. The roll, which is still connected to the web, then falls into a receiving tub. The means for severing the web from the roll includes pairs of gripping jaws disposed on opposite sides of the winding station, and a cutting knife is disposed between the pairs of jaws. Before the web which is gripped by the jaws is severed, the web is tensioned by a tensioning device so that the properly aligned and spread winding pins can be advanced toward each other in order to engage the web. That winding apparatus does not permit a winding up and severing of a continuously supplied web. The web must be stopped for the severing of each roll consisting of a web section having a predetermined length, and it must be gripped by separate gripping means on both sides of the winding station and must be severed by a separate cutting device. As a result, the winding rate is restricted and the structural expenditure is increased.

It is an object of the present invention to provide web winding apparatus and in which the winding of the web sections to form supply rolls requires smaller axial displacements and smaller radial spreading movements of the winding pins.

SUMMARY OF THE INVENTION

Briefly stated, in accordance with one aspect of the present invention, apparatus is provided for winding up without using a core a web section that has been torn along a transverse perforation line from a web that is continuously supplied and provided with longitudinally spaced transversely extending perforation lines. The apparatus includes a frame, and a pair of winding stations each including a pair of aligned and opposed winding heads defining a winding axis and spaced transversely from each other relative to the web movement direction. The winding heads each carry a pair of rotatably mounted winding pins that are movable within an associated winding head along the winding axis from an extended position to a retracted position relative the winding head. Rotary drive means are provided for rotating pairs of the winding heads and the winding pins about the winding axis. The winding pins protrude freely from the winding heads when they are in the extended position and are spread outwardly relative to each other, and are retractable to a non-spread position wherein the web extends between the winding pins of one winding station when the web is wound up on the other winding station, and wherein when the web is to be taken over by the other winding station, the winding pins of that other winding station are extended from their retracted position to their extended position in which they hold the web therebetween. The winding pins are spaced from each other on opposite sides of the winding axis at a distance sufficient to permit the web to move freely between the winding pins, and the pins are movable relative to each other in spaced parallel planes from a spread position to a non-spread position.

DESCRIPTION OF THE PREFERRED EMBODIMENTS

Figure 1:
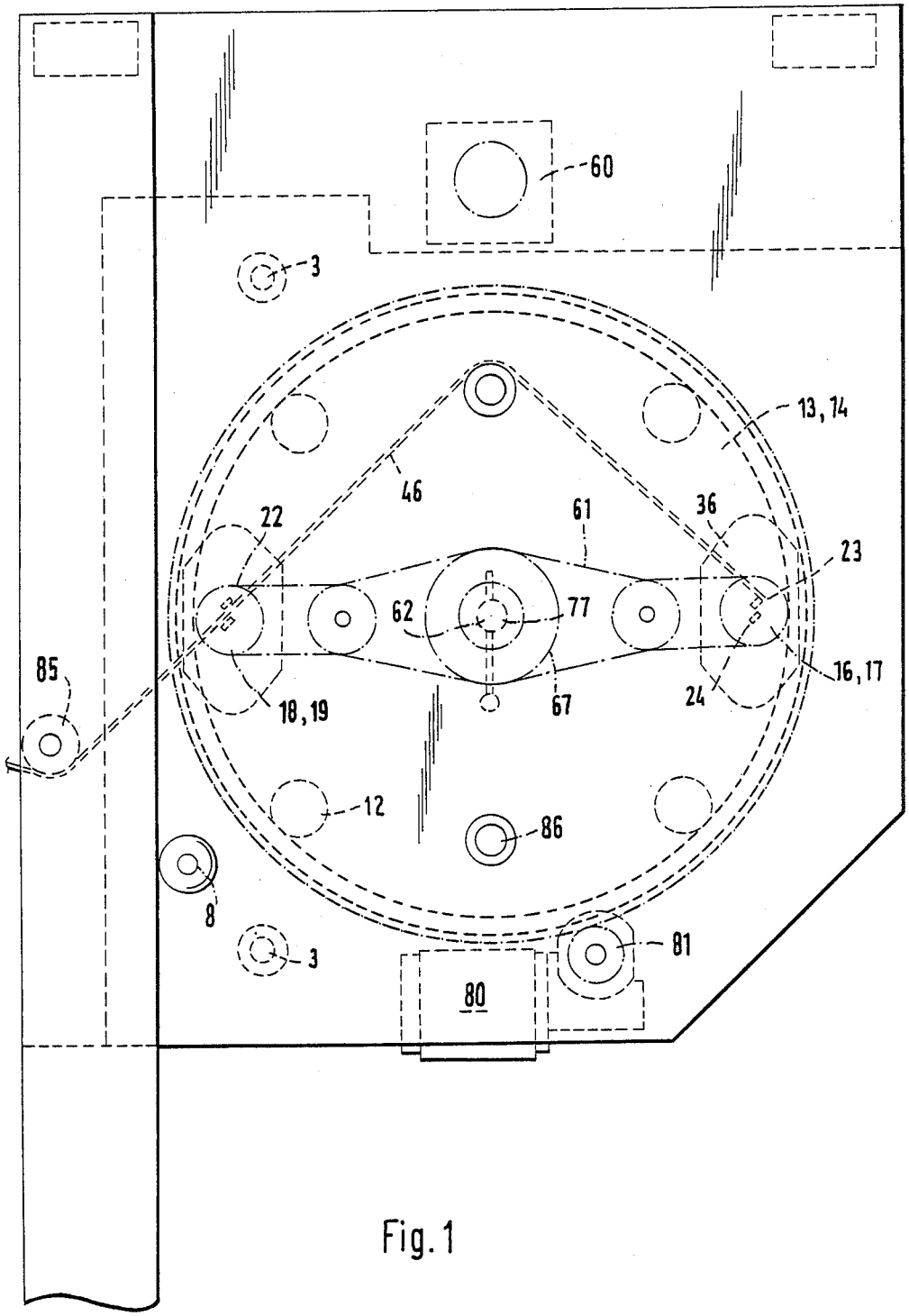
FIG. 1 is a side elevation showing winding apparatus in accordance with the present invention and including two winding stations.
Figure 2:
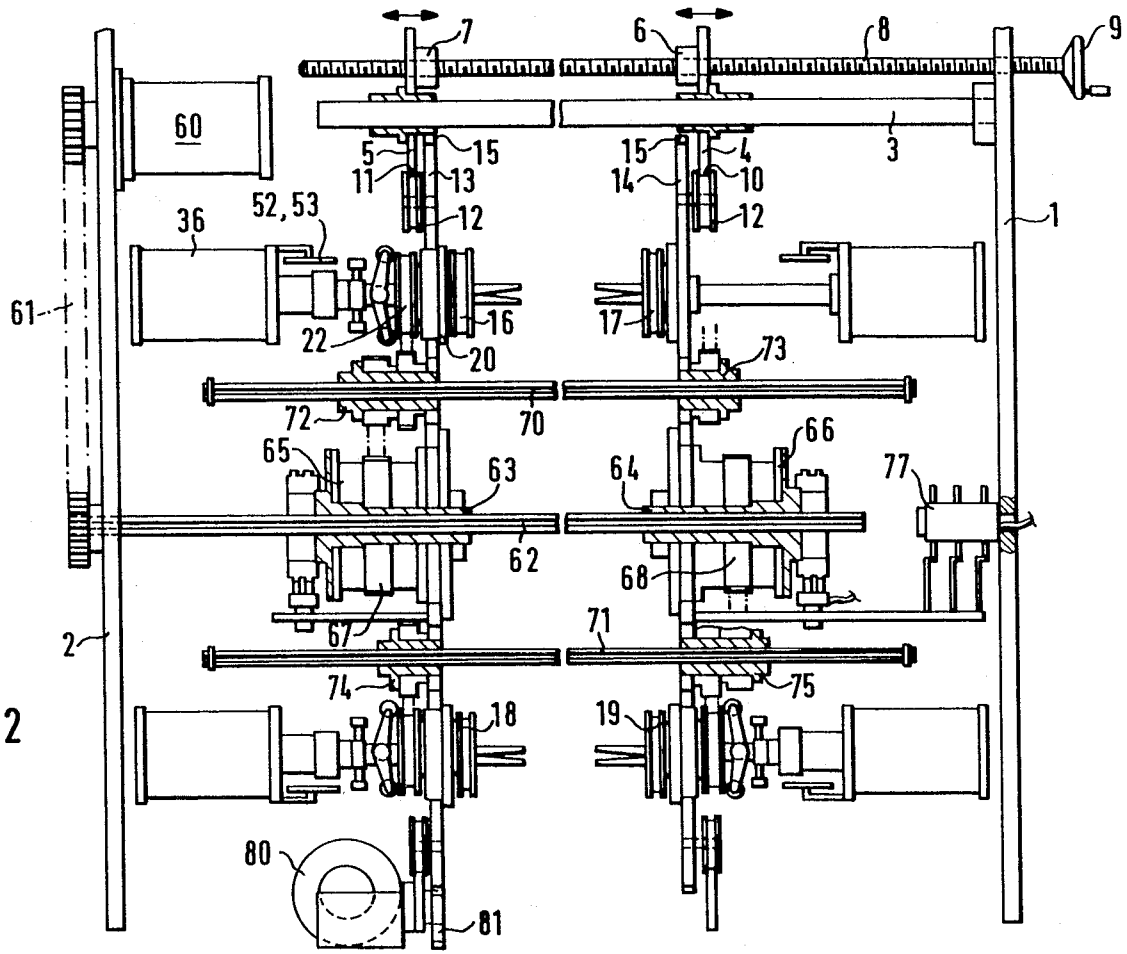
FIG. 2 is a front elevational view showing the winding apparatus of FIG. 1.

Referring now to the drawings, and particularly to FIGS. 1 and 2 thereof, there is shown a machine frame 1*a* that includes a pair of parallel, spaced side walls 1, 2, that are interconnected by a pair of parallel guide bars 3. A pair of sleeves 4*a*, *5a* are slidably carried on the guide bars, which define a pair of tracks between side walls 1 and 2, and sleeves 4*a*, 5*a*, support annular carrying rings 4, 5, respectively, for movement along the guide bars and between the side walls of the frame. Rings 4 and 5 each define circular openings, the purposes of which will hereinafter be described in greater detail. Also carried by sleeves 4*a* and 5*a* are nuts 6 and 7, respectively, that have internal threads that are engageable with the external threads of a screw 8 that extends between side walls 1 and 2 in a direction parallel to the axis of guide bar 3. The external threads on screw 8 are of opposite hand on respective halves of the screws, so that upon rotation of screw 8 each of nuts 6 and 7, and also sleeves 4*a* and 5*a*, can be moved toward and away from each other in the directions indicated in FIG. 2 by the double headed arrows about screw 8. A handwheel 9 is provided on one end of screw 8, and the screw is rotatably carried and is axially fixed in the side walls 1 and 2.

Carrying rings 4 and 5 are of similar construction, and the ensuing description will be based upon carrying ring 5 and its associated structural components, and it is to be understood that the description applies with equal effect to carrying ring 4 and its associated structural components. Carrying ring 5 includes an inner circular rim portion 10 that engages with peripheral grooves of a plurality of rollers 12, four of which are shown in phantom in FIG. 1, for circular movement around the axis of rim portion 11. A circular disc 13 is provided adjacent to carrying ring 5 and includes external teeth 15 that are engageable with an output pinion 81 of a motor 80, rotation of which serves to rotate disc 13. Rollers 12 are each rotatably carried by circular disc 13 and serve to support disc 13 for circular movement about the central axis of rim portion 11. Spaced opposite from and facing circular disc 13 is a second circular disc 14 that is parallel to disc 13 and also carries a plurality of rollers 12, which engage with inner rim portion 10 of carrying ring 4, in the same manner as in the corresponding structure hereinabove described in connection with circular disc 13.

Each of discs 13 and 14 carries a winding head 16, 17, which because they are identical except for their orientation relative to each other, will be described in terms of the structure of winding head 16, and it will be understood that winding head 17, as well as winding heads 18 and 19 that are spaced diagonally opposite from winding heads 16 and 17 on discs 13 and 14. have the same structure and functions as winding head 16. winding heads 16 and 17 lie on one winding axis and winding heads 18 and 19 lie on a second winding axis.

Figure 3:
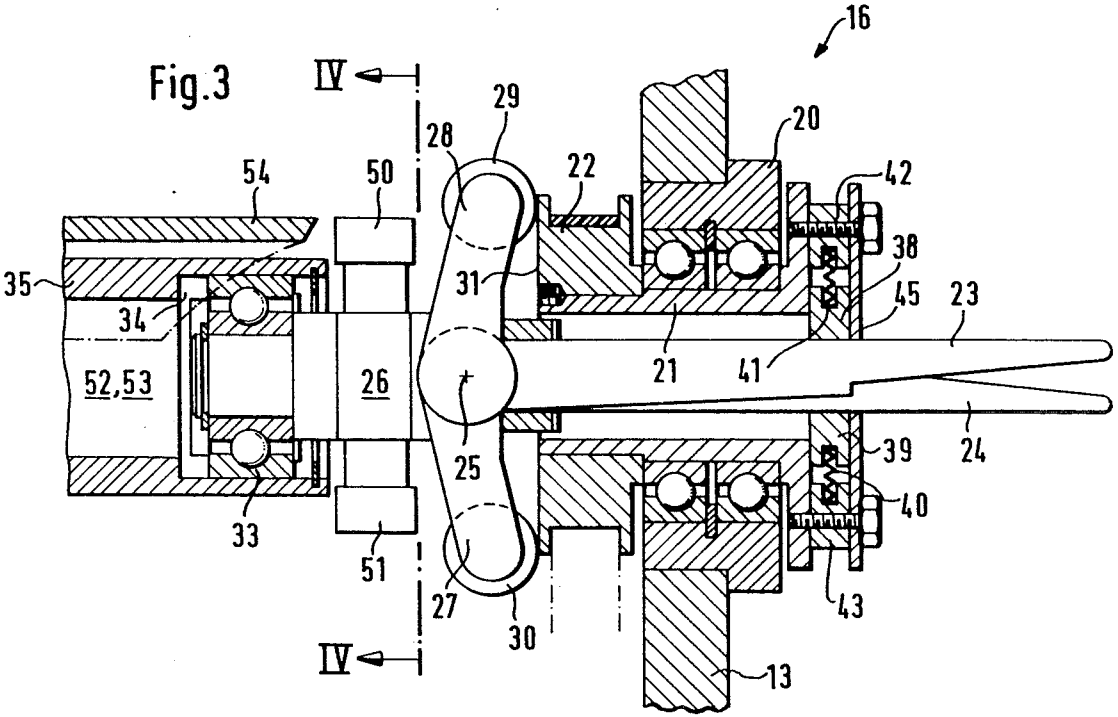
FIG. 3 is an enlarged, fragmentary cross-sectional view showing a winding head of one winding station.

Referring now to FIG. 3, which shows a fragmentary portion of circular disc 13, a bore 13*a* in disc 13 carries a bearing ring 20 that includes an outwardly extending flange 20*a* that engages one face of circular disc 13. A pair of rolling element bearings 21*a*, 21*b*, are carried within bearing ring 20 in axially spaced relationship. The outer races of the bearings engage with and rotate with bearing ring 20, and the inner races engage with and rotate with a bushing 21 that includes an outwardly extending annular flange 21*c* that faces circular disc 14. Bushing 21 carries a pulley 22 that is keyed thereto in order to rotate therewith, and a toothed belt 22*a* passes around pulley 22 to rotatably drive bushing 21 about a winding axis that passes through the center of bushing 21.

Positioned within bushing 21 is a pair of winding pins 23, 24, which are substantially flat, elongated strips of metal that are disposed in scissor-like relationship. Each of winding pins 23, 24, is the longer arm of one of a pair of bell-crank levers that include shorter arms 28 and 27, respectively. The bell-crank levers are pivotable about a common pivot 25 which extends transversely of the winding axis and is carried by a holder 26. The outer ends of shorter arms 28 and 27 carry rollers 29 and 30, respectively, which bear against the outer end face 31 of pulley 22 and move in a radial direction relative to the winding axis.

Winding pins 23 and 24 each have ends that extend outwardly beyond flange 21*c* of bushing 21, and are held in position relative to each other by means of a plate 45 that includes a pair of spaced, parallel slots to receive respective winding pins 23 and 24. The slots have a length greater than the width of the winding pins to permit the pins to move in scissor-like relationship, while they are spaced a predetermined distance from each other and move in parallel planes from an extended position wherein the winding pins are in an opened position relative to each other and extend outwardly beyond plate 45, to a retracted position wherein they are in a closed scissor position and in substantially opposed relationship and are partially retracted into bushing 21. Plate 45 is held in position by a plurality of bolts 42*a*, 43*a* which are received in threaded holes in flange 21*c*. A pair of abutments 42, 43, are also held in position by bolts 42*a* and 43*a*, respectively, and are on diametrically opposite sides of the winding axis. Each of abutments 42 and 43 receives one end of a compression spring 41, 40, respectively, the innermost ends of which springs bear against pressure applying members 38, 39, respectively, that, in turn, engage the outermost edges of winding pins 23 and 24, respectively. The springs urge the pressure applying members against the winding pins to move them to the clsoed, overlapped position.

Holder 26 is rotatably carried in an axial bore 34 of a piston rod 35 by means of a rolling element bearing 33. As best seen in FIG. 2, piston rod 35 extends from a pneumatic cylinder 36. Cylinder 36 is secured to circular disc 13 by means of a flange plate 36a that is connected to disc 13 by means of a plurality of studs (not shown) that have axes that are parallel to the axis of cylinder 36 and piston rod 35. Thus the axial extension and retraction of piston rod 35 causes corresponding axial movement along the winding axis of holder 26, and also of winding pins 23 and 24. Further, because of the rotatable mounting between holder 26 and piston rod 35, holder 26 rotates together with bushing 21 about the winding axis.

Figure 4:
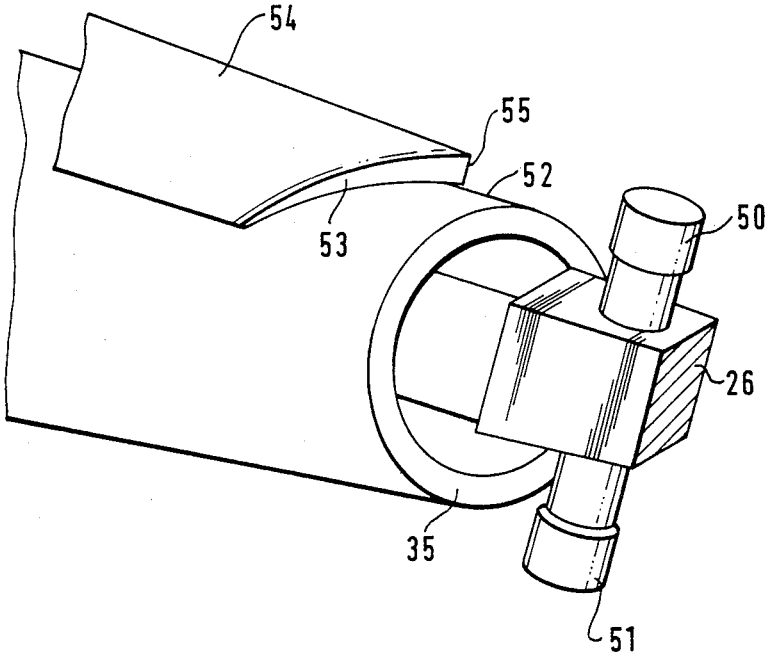
FIG. 4 is a fragmentary cross-sectional view taken on line IV—IV in FIG. 3 and showing the piston rod and the holder associated with one winding head.

As best seen in FIG. 3, holder 26 includes a forked end portion 26a between which the winding pins 23 and 24 are carried in pivotable relationship about pivot 25, and also includes radially extending arms 50 and 51, which are offset 180° from each other about the axis of rotation of holder 26. As shown in FIGS. 3 and 4, positioned about piston rod 35, and in concentric relationship therewith, is a sleeve 54 that includes a pair of cam tracks 52, 53, formed by two substantially elliptically curved surfaces that each extend symmetrically from a top apex 55 in a direction away from disc 13. When one of radial arms 50 or 51 contacts one of cam tracks 52 or 53, as piston rod 35 is retracted into cylinder 36 and away from winding head 16, the end of the radial arm will slide along the cam track portion, and will thereby rotate holder 26 about the winding axis until the opposite arm has engaged the opposite portion of the cam track. In that position, continued retracting movement is prevented, and winding pins 23 and 24 and then so aligned relative to the direction of movement of the web to permit the web to pass between the winding pins, which are spaced from each other, so that the web is passed between the opposed faces of the winding pins as they are advanced once again by piston rod 35 of pneumatic cylinder 36 to an extended position relative to plate 45. The relative orientation of piston rod 35, sleeve 54, cam track 53, apex 55, and radially extending arms 50 and 51 is shown in perspective in FIG. 4 of the drawings.

Referring once again to FIGS. 1 and 2, each of discs 13 and 14 carries two pairs of opposed winding heads 16, 17, and 18, 19. The winding heads are driven by a motor 60, that is supported on the inner surface of side wall 2 and from which a disc pulley 60*a* extends. A cogged drive belt 61 extends around pulley 60*a* and also around a driven pulley 62*a* that is secured to a central splined shaft 62 that is rotatably carried in side walls 1 and 2 and is substantially centrally positioned relative to the rim portion 11 of annular ring 5. A hub 63 is carried on splined shaft 62 and, in turn, carries a clutch-brake combination 65 that includes a pulley 67. A drive belt 67*a* passes around pulley 67 and also around pulley 72*a* that is carried by hub 72, which, in turn, is slidably carried on intermediate splined shaft 70 for rotation therewith. Shaft 70 is spaced from and parallel to central splined shaft 62. Hub 72 is carried in circular disc 13 and also rotatably carries pulley 72*b*, which rotates with pulley 72*a* and about which belt 22 passes to interconnect pulley 72*b* with pulley 22 of winding head 16.

Clutch-brake combination 65 is of known construction familiar to those skilled in the art, and can be operated electrically, such as by slip rings 77. The purpose of clutch-brake combination 65 is to selectively transmit driving torque to the winding head and to restrain the winding head from rotation relative to disc 13.

Pneumatic cylinders 36 are operated from a source of compressed air (not shown) that can be supplied through lines that extend from cylinder 36 to central splined shaft 62 by means of a rotary connection, similar to a slip ring, or the like.

In operation, web 46, shown in FIG. 1, passes around a guide roll 85 to a winding station defined by winding heads 16 and 17, which are positioned as shown in FIG. 2. The web also extends between the spaced winding pins of winding heads 18 and 19.

The web passes about an element 86 located between winding stations. When a sufficiently long web section having a predetermined length and including a predetermined number of articles, such as, for example, garbage bags, which are separated by transversely extending perforation lines, has been wound up on winding heads 16 and 17, the clutch-brake combinations 65 and 66 are actuated so that the winding heads 16 and 17 are stopped and the winding heads 18 and 19 are started. As the latter are started, the web is torn along a transverse perforation line which is disposed between the two winding stations. As a result, the winding pins in the completed roll of articles can be retracted so that the roll can be removed and the next following roll can be wound in the other winding station.

As a roll is being wound, the circular discs 13 and 14 are rotated together to change the locations of the respective winding stations so that winding heads 16 and 17 can be moved to the lower position shown in FIGS. 1 and 2. Those winding pins that have been retracted during the shifting of the winding stations are subsequently re-extended to be disposed on opposite sides of the web 46, and are then ready to start the next succeeding winding cycle.

Although particular embodiments of the present invention have been illustrated and described, it will be apparent to those skilled in the art that various changes and modifications can be made without departing from the spirit of the present invention. It is therefore intended to encompass in the appended claims all such changes and modifications that fall within the scope of the present invention.

What is claimed is:

1. Apparatus for winding up without using a core a web section which has been torn along a transverse perforation line from a web which is continuously supplied and provided with longitudinally spaced transversely extending perforation lines, which apparatus comprises:

a frame;

a pair of winding stations carried by said frame, each winding station including a pair of aligned and opposed winding heads defining a winding axis and spaced transversely from each other relative to the web movement direction, said winding heads each carrying a pair of rotatably mounted winding pins movable within an associated winding head along the winding axis from an extended, spread position to a retracted, non-spread position relative to the winding head while pivoting for scissor-like movement about a common axis transverse to the winding axis; means for extending said winding pins from said retracted, non-spread position to said extended, spread position and for retracting said winding pins from said extended, spread position to said retracted, non-spread position;

rotary drive means for rotating pairs of said winding pins together about a winding axis; and means rotatably mounted in said frame and connected to said rotary drive means for carrying the winding stations;

said winding pins protruding freely from said winding heads when in the extended, spread position and spread outwardly relative to each other in a transverse direction relative to the winding axis, and retractable to said retracted, non-spread position, wherein the web to be wound extends between each pair of winding pins of one winding station when the web is wound up in the other winding station, and wherein the web is subsequently wound up in the one winding station, and wherein when the web is wound up in the other winding station, the winding pins of said other winding station are extended from their retracted, non-spread position to their extended, spread position, in which they hold the web therebetween, said winding pins spaced from each other on opposite sides of the winding axis and movable apart by said means for extending and for retracting said winding pins a distance sufficient to permit the web to move freely between said winding pins, said means for extending and retracting said winding pins moving said winding pins relative to each other in spaced parallel planes from said extended, spread position to said retracted, non-spread position.

2. Apparatus for winding up without using a core a web section which has been torn along a transverse perforation line from a web which is continuously supplied and provided with longitudinally spaced transversely extending perforation lines, which apparatus comprises:

a frame;

a pair of winding stations carried by said frame, each winding station including a pair of aligned and opposed winding heads defining a winding axis and spaced transversely from each other relative to the web movement direction, said winding heads each carrying a pair of rotatably mounted winding pins movable within an associated winding head along the winding axis from an extended, spread position to a retracted, non-spread position relative to the winding head; means for extending said winding pins from said retracted, non-spread position to said extended, spread position and for retracting said winding pins from said extended, spread position to said retracted, non-spread position; and rotary drive means for rotating pairs of said winding pins together about a winding axis, said winding pins protruding freely from said winding heads when in the extended, spread position and spread outwardly relative to each other in a transverse direction relative to the winding axis, and retractable to said retracted, non-spread position, wherein the web to be wound extends between each pair of winding pins of one winding station when the web is wound up in the other winding station, and wherein the web is subsequently wound up in the one winding station, and wherein when the web is wound up in the other winding station, the winding pins of said other winding station are extended from their retracted, non-spread position to their extended, spread position, in which they hold the web therebetween, said winding pins spaced from each other on opposite sides of the winding axis and movable apart by said means for extending and for retracting said winding pins a distance sufficient to permit the web to move freely between said winding pins, said means for extending and retracting said winding pins moving said winding pins relative to each other in spaced parallel planes from said extended, spread position to said retracted, non-spread position, carrying plates for carrying the winding stations, said carrying plates rotatably mounted in said frame and connected to said rotary drive means, wherein said winding pins each define one arm of a two arm bell-crank lever and pairs of winding pins are pivoted for scissor-like movement about a common axis transverse to the winding axis, respective pairs of said winding pins mounted in a holder rotatably carried at one end of a piston rod extending along the winding axis, the other end of said piston rod carried within a fluid-operable piston-cylinder means, the cylinder of which is fixed to said frame, guiding means for guiding said pairs of winding pins for movement along the winding axis, spring means supported on said carrying plates for urging said winding pins toward a non-spread position as said winding pins are retracted from said extended, spread position, wherein the other arms of the bell-crank levers extend approximately at right angles to the winding pins and include ends that contact the carrying plates to cause the winding pins to move to a spread position when the winding pins are extended from the winding head.

3. Apparatus according to claim 2, wherein said spring means include pressure-applying members transversely guided relative to the winding axis to bear on respective ones of the winding pins, and wherein said plates carry abutment means, and compression springs positioned between said pressure-applying members and said abutment means for urging said pressure-applying members against said winding pins.

4. Apparatus according to claim 2, wherein said carrying plates include a drive pulley secured thereto for rotation about the winding axis, and wherein the ends of the other arms of the bell-crank levers bear on an outer end face of said drive pulley.

5. Apparatus according to claim 2, wherein the ends of the other arms of the bell-crank levers include roller means for permitting rolling contact with said carrying plates.

6. Apparatus according to claim 2, including cam track means carried by said frame, and wherein said holder includes an arm that extends substantially radially outwardly of said winding axis and which contacts said cam track to rotate a pair of winding pins to a position wherein the web can be freely passed therebetween as said winding pins are moved to their extended, spread position during retraction of the piston rod into the piston-cylinder means.

7. Apparatus according to claim 2, including cam track means carried by said frame and concentrically surrounding said piston rod, said cam track means including two symmetrical cam track portions, that extend from an apex in a direction away from an associated winding head and are elliptically curved, and wherein said holder includes two radially extending arms that are offset 180° from each other about the winding axis.

8. Apparatus according to claim 2, wherein said carrying plates include circular discs, at least one of said discs having external teeth, drive pinion means in meshing engagement with said external teeth for rotating said carrying plate, and wherein said winding stations are mounted on the carrying plates and are offset 180° from each other relative to the winding axis.

9. Apparatus according to claim 8, including a central shaft rotatably mounted in the carrying plates and rotatable by said rotary drive means, clutch-brake means carried by said control shaft and operatively connected in alternation to one of two intermediate shafts parallel to and spaced transversely from said central shaft and that are also rotatably mounted in the carrying plates, said intermediate shafts being drivingly connected with respective pairs of opposed winding heads so that rotation is imparted to the winding stations by the intermediate shafts.

10. Apparatus according to claim 8, including annular track ring means carried by said frame, said carrying plates including at least three radially disposed wheels having peripheral groove engageable with said annular track means for rotatably supporting said carrying plates on said frame.

11. Apparatus according to claim 10, including guide bars carried by said frame and extending transversely relative to the web direction, wherein said annular track ring means are transversely slidably guided on said guide bars for movement toward and away from each other, and adjusting means carried by said frame and engageable with said annular track ring means for adjusting the transverse spacing between said ring means

* * * * *